US012331387B2

(12) United States Patent
Chen et al.

(10) Patent No.: US 12,331,387 B2
(45) Date of Patent: Jun. 17, 2025

(54) MODIFIED TIN-PHOSPHOR BRONZE ALLOY AND A PREPARATION METHOD THEREOF

(71) Applicants: Chinalco Research Institute of Science and Technology Co., Ltd, Beijing (CN); China Copper Industry Co., Ltd, Kunming (CN)

(72) Inventors: Zhongping Chen, Beijing (CN); Huafen Lou, Beijing (CN); Chaojian Xiang, Beijing (CN); Hu Wang, Beijing (CN); Yongda Mo, Beijing (CN); Miaomiao Wang, Beijing (CN)

(73) Assignees: Chinalco Research Institute of Science and Technology Co., Ltd, Beijing (CN); China Copper Industry Co., Ltd, Kunming (CN)

( * ) Notice: Subject to any disclaimer, the term of this patent is extended or adjusted under 35 U.S.C. 154(b) by 0 days.

(21) Appl. No.: 18/666,687

(22) Filed: May 16, 2024

(65) Prior Publication Data

US 2024/0410044 A1 Dec. 12, 2024

(30) Foreign Application Priority Data

Jun. 8, 2023 (CN) ..... 202310679098.7

(51) Int. Cl.
*C22F 1/08* (2006.01)
*B22D 11/00* (2006.01)
(Continued)

(52) U.S. Cl.
CPC ..... *C22F 1/06* (2013.01); *B22D 11/004* (2013.01); *B22D 11/045* (2013.01); *C22C 9/02* (2013.01); *C22F 1/02* (2013.01)

(58) Field of Classification Search
CPC . C22F 1/08; C22F 1/02; B22D 11/004; B22D 11/045; C22C 9/02; B23P 15/00; C21D 9/52
See application file for complete search history.

(56) References Cited

U.S. PATENT DOCUMENTS

2024/0410043 A1* 12/2024 Lou ..... C22F 1/02

FOREIGN PATENT DOCUMENTS

CN 106868280 A 6/2017
CN 113088756 A 7/2021
(Continued)

OTHER PUBLICATIONS

CN-113106291-A, machine translation. (Year: 2021).*
CN-116121585-A, machine translation. (Year: 2023).*
CN-116287851-A, machine translation. (Year: 2023).*

*Primary Examiner* — John A Hevey
(74) *Attorney, Agent, or Firm* — The Sun IP Law

(57) ABSTRACT

The disclosure provides a modified tin-phosphor bronze alloy and a preparation method thereof. The modified tin-phosphor bronze alloy comprises the following elements in percentage by mass: 4.0-10 wt % of Sn, 0.01-0.3 wt % of P and the balance of Cu and inevitable impurity elements, the average grain size of the modified tin-phosphor bronze alloy is 1-3 μm, the grain size is in normal distribution, and the standard deviation of the grain size is below 0.8 μm; the proportion of the total low-CSL grain boundary in the modified tin-phosphor bronze alloy in the whole grain boundary is 66-74%, and in the total low-ΣCSL grain boundary, the ratio range of (Σ9+Σ27)/Σ3 is (0.12-0.23):1. The modified tin-phosphor bronze alloy of this disclosure enables a finished alloy can give consideration to both tensile strength and excellent bending performance.

13 Claims, 3 Drawing Sheets

(51) Int. Cl.

| | |
|---|---|
| ***B22D 11/045*** | (2006.01) |
| ***C22C 9/02*** | (2006.01) |
| ***C22F 1/02*** | (2006.01) |
| ***C22F 1/06*** | (2006.01) |

(56) References Cited

FOREIGN PATENT DOCUMENTS

| | | | | | |
|---|---|---|---|---|---|
| CN | 113106291 | A | * | 7/2021 | ..... B21C 37/04 |
| CN | 114875270 | A | | 8/2022 | |
| CN | 114908270 | A | | 8/2022 | |
| CN | 116121585 | A | * | 5/2023 | |
| CN | 116287851 | A | * | 6/2023 | ..... B22D 11/143 |
| JP | 2010275569 | A | | 12/2010 | |
| KR | 20030080692 | A | | 10/2003 | |

* cited by examiner

MODIFIED TIN-PHOSPHOR BRONZE ALLOY AND A PREPARATION METHOD THEREOF

TECHNICAL FIELD

The disclosure relates to the technical field of tin-phosphor bronze alloy, in particular to a modified tin-phosphor bronze alloy and a preparation method thereof.

BACKGROUND

For polycrystalline materials, grain boundaries are an important component of the microstructure in a material, and the number, type, and distribution of grain boundaries play a crucial role in the performance of a material. In terms of mechanical properties, grain boundaries are the main obstacles for dislocation and gliding during plastic deformation, becoming an important source of strength and work hardening for polycrystalline metal materials. Meanwhile, grain boundaries are also the preferred location for crack nucleation, as the bonding strength between atoms on both sides of the structurally disordered interface is weakened and higher stress concentration is caused by the accumulation of dislocations. However, it is most worth noting that there are significant differences in the structural grades of different grain boundaries, therefore, different grain boundaries have varied abilities to resist intergranular cracks and fractures. On this basis, WATANABE first proposed the concept of "Grain Boundary Design and Control" in 1984, which was later developed into "Grain boundary engineering (GBE)". The central idea of grain boundary engineering is to regulate the distribution of grain boundary character distribution (GBCD) of a material through a certain thermo-mechanical process, in order to increase the proportion of low-ΣCSL grain boundary, so that the connectivity of random grain boundary networks can be blocked, thereby achieving the purpose of improving the performance of a material.

However, Most GBEs increase the proportion of special boundaries in the middle-low stacking fault energy metal alloys based on the formation of annealed twinning, where special boundaries refer to those grain boundaries with low Σ coincident site lattice (CSL) ($1 \leq \Sigma \leq 29$) exhibit strong inhibitory effects on properties such as corrosion, fracture, and solute segregation, etc., and in some cases they can even achieve complete avoidance of the above, while random grain boundaries ($\Sigma > 29$) often become the core of crack initiation and the channel for crack propagation due to their low degree of structural order, large free volume, and high interfacial energy. Therefore, it is a proven and effective method to improve the grain boundary related properties of a material by controlling and optimizing the grain boundary structure of a polycrystalline material.

In the Chinese patent disclosure with Patent disclosure publication number CN106011710 A, a processing method for obtaining high-proportion special grain boundary from tin bronze is disclosed, wherein the technology involves deforming the workpiece by 5-40%, then placing it in an environment of 400-800° C. for heat preservation for 0.5-5 hours, and then subjecting same to water quenching to room temperature to achieve the purpose of obtaining a high proportion of special boundaries. However, this patent only considers increasing the proportion of specific grain boundaries without considering the influence of grain size on the mechanical properties and bending formability of the strip. In other words, in this patent, the strengthening effect of fine grains is not associated with the synergistic control of high proportion of special boundaries, resulting in only obtaining a high proportion of special boundaries, but the grains have grown or the original grain size is already large, and thus failing to achieve the purpose of high mechanical strength and better bending formability. Furthermore, the proportion of Σ3, Σ9 and Σ27 grain boundaries in the low-ΣCSL grain boundary was not studied in this technology, however the proportion of Σ3, Σ9 and Σ27 grain boundaries has significantly effect on breaking the network of random high-angle grain boundaries, which further indicates that this technology has not achieved the high mechanical strength and excellent bending formability of tin bronze. However, it is of less value for the practical application of tin bronze with simply increasing the proportion of special boundaries without considering the properties of high mechanical strength and excellent bending formability, etc., of tin bronze.

Therefore, it is not possible to fundamentally make the finally obtained tin bronze have both fine grains and a high proportion of special boundaries. Therefore, it is urgently needed to develop a process capable of increasing the proportion of special boundaries in tin bronze.

SUMMARY

The main object of the present disclosure is to provide a modified tin-phosphor bronze alloy and a preparation method thereof, in order to solve the problem in the prior art that the tin-phosphor bronze cannot achieve high mechanical strength and excellent bending formability at the same time due to the low proportion of special boundaries.

In order to achieve the above object, according to one aspect of the present disclosure, a modified tin-phosphor bronze alloy is provided, which includes the following elements in percentage by mass: 4.0-10 wt % of Sn, 0.01-0.3 wt % of P and the balance of Cu and inevitable impurity elements, wherein the average grain size of the modified tin-phosphor bronze alloy is 1-3 μm, the grain size is in normal distribution, and the standard deviation of the grain size is below 0.8 μm; the proportion of the total low-ΣCSL grain boundary in the modified tin-phosphor bronze alloy in the whole grain boundary is 66-74%, and in the total low-ΣCSL grain boundary, the ratio range of (Σ9+Σ27)/Σ3 is 0.12-0.23:1.

Further, in the total low-ΣCSL grain boundary, the length fraction of the Σ3 grain boundary is 56-61%, the length fraction of the Σ9 grain boundary is 5-8%, and the length fraction of the Σ27 grain boundary is 2.5-4.5%.

Further, the above mentioned standard deviation is 0.6-0.8 μm.

According to another aspect of the present disclosure, a preparation method of the above mentioned modified tin-phosphor bronze alloy is provided, which includes subjecting the pretreated tin-phosphor bronze alloy workpiece to modification treatment so as to obtain the modified tin-phosphor bronze alloy; wherein the modification treatment includes a cold rolling deformation step and a heat treatment step carried out sequentially and wherein the average grain size of the pretreated tin-phosphor bronze alloy workpiece is 1-3 μm.

Further, the deformation amount of the above mentioned cold rolling deformation step is 7-15%.

Further, the temperature of the above mentioned heat treatment step is 380-500° C., and the heat preservation time of the heat treatment step is preferably 1-4 hours.

Further, the above mentioned preparation method further comprises: repeating the modification treatment multiple times, preferably performing 2-5 times of the modification treatment.

Further, the above mentioned preparation method further includes a preparation process flow of the pretreated tin-phosphor bronze alloy workpiece, which includes a batching step, a horizontal continuous casting step, a homogenization annealing step, a face milling step, a cold rolling cogging step, a first recrystallization annealing step, an intermediate rolling deformation step, a second recrystallization annealing step, a finish rolling deformation step, a third recrystallization annealing step, a bottom reservation rolling step, and a fourth recrystallization annealing step carried out sequentially, wherein the temperature of the homogenization annealing step is 650-690° C., and the heat preservation time of the homogenization annealing step is preferably 6-8 hours; and the deformation amount of the cold rolling cogging step is preferably 80-90%; the deformation amount of the bottom reservation rolling step is preferably 40-55%; the deformation amount of the intermediate rolling deformation step is preferably 50-70%; and the deformation amount of the finish rolling deformation step is preferably 40-60%.

Further, the temperature of the above mentioned first recrystallization annealing step is 540-580° C., and the heat preservation time of the first recrystallization annealing step is preferably 4-6 hours; the temperature of the second recrystallization annealing step is preferably 450-500° C., and the heat preservation time of the second recrystallization annealing step is preferably 4-6 hours.

Further, the temperature of the above mentioned third recrystallization annealing step is 650-750° C., and the heat preservation time of the third recrystallization annealing step is preferably 20-60 seconds; the temperature of the fourth recrystallization annealing step is preferably 600-650° C., and the heat preservation time of the fourth recrystallization annealing step is preferably 20-60 seconds.

Further, the atmospheres for the above mentioned first recrystallization annealing step and the second recrystallization annealing step are each independently a first mixed gas of nitrogen and hydrogen, and the first mixed gas preferably comprises 15-30% of $H_2$ and 70-85% of $N_2$ in percentage by volume; preferably, the atmospheres for the third recrystallization annealing step and the fourth recrystallization annealing step are each independently a second mixed gas of nitrogen and hydrogen, and the second mixed gas preferably comprises 3-5% of $H_2$ and 95-97% of $N_2$ in percentage by volume.

By applying the technical solution of the present disclosure, compared with traditional tin-phosphor bronze, on the one hand, the average grain size of the modified tin-phosphor bronze alloy in this disclosure is 1-3 μm, the grain size is in uniform normal distribution with a standard deviation of below 0.9 μm, achieving the fine and uniform grain structure, which enables the modified tin-phosphor bronze alloy to fully play the role of fine-grain strengthening, thereby obtaining a modified tin-phosphor bronze alloy with higher strength. On the other hand, the modified tin-phosphor bronze alloy of this disclosure has a low-ΣCSL grain boundary with a high length fraction, a large amount of special boundaries can effectively hinder the dislocation movement, and have lower volume free energy, that is, on the premise of controlling the average grain size of the modified tin-phosphor bronze alloy at 1-3 μm, allowing the proportion of total low-ΣCSL grain boundaries to be higher, especially by controlling the content of sum of Σ9 and Σ27 grain boundaries and the proportion of Σ3 grain boundaries within the above range, allowing the deformation amount in the subsequent finished product processing to be relatively small, so that the required strength requirements can be achieved, while retaining more proportions of special boundaries, so that the finished alloy has more excellent bending processing resistance, and further, the finished alloy can give consideration to both tensile strength and excellent bending performance.

BRIEF DESCRIPTION OF THE DRAWINGS

The accompanying drawings of the description, which form a part of the disclosure, are used to provide a further understanding of the disclosure. The illustrative embodiments and their descriptions of the disclosure are used to explain the disclosure, and do not constitute an improper limitation thereto. In the accompanying drawings.

DETAILED DESCRIPTION OF THE EMBODIMENTS

Figure 1:
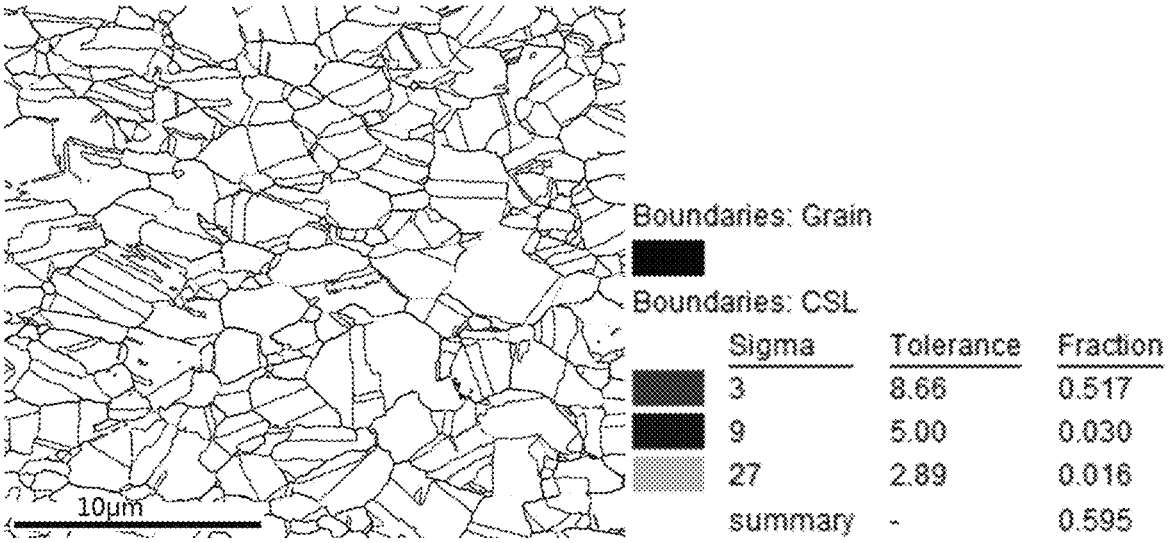
FIG. 1 shows the photograph of the microstructure and the special grain boundary proportion diagram of the pretreated tin-phosphor bronze alloy workpiece provided in Embodiment 12 of this disclosure after the fourth recrystallization annealing.
Figure 2:
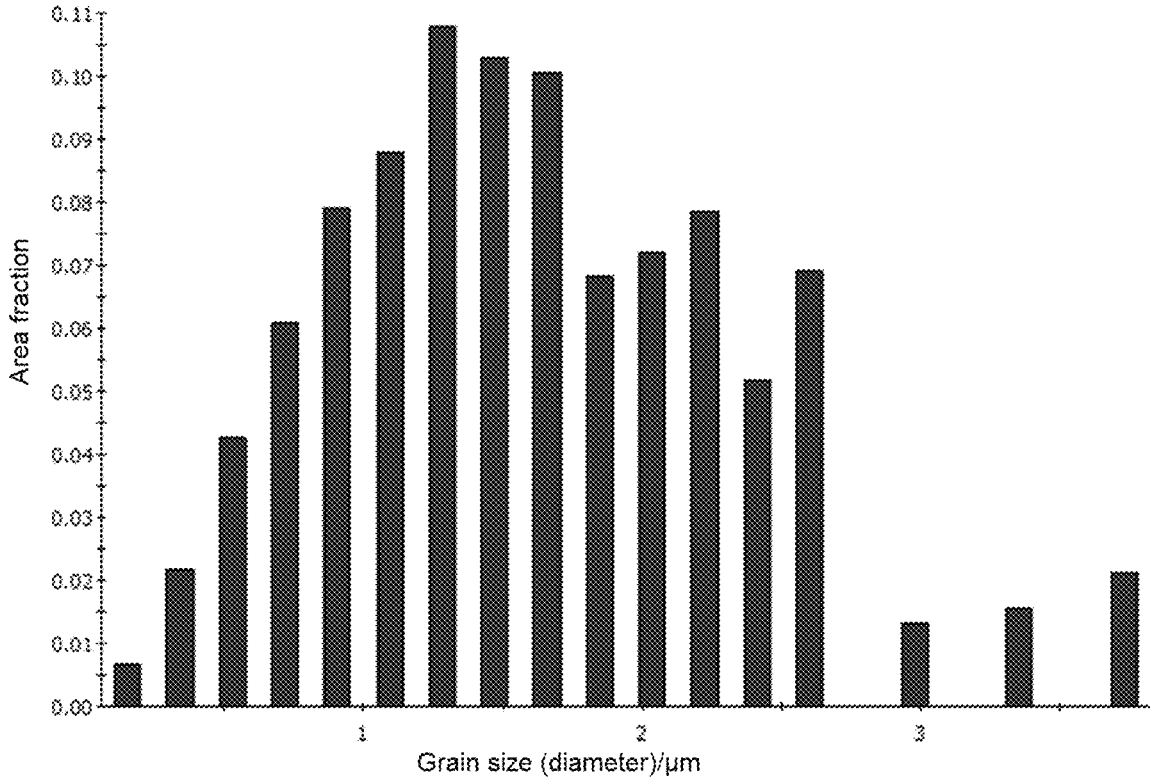
FIG. 2 shows the alloy grain size distribution diagram of the pretreated tin-phosphor bronze alloy workpiece provided in Embodiment 12 of this disclosure after the fourth recrystallization annealing.
Figure 3:
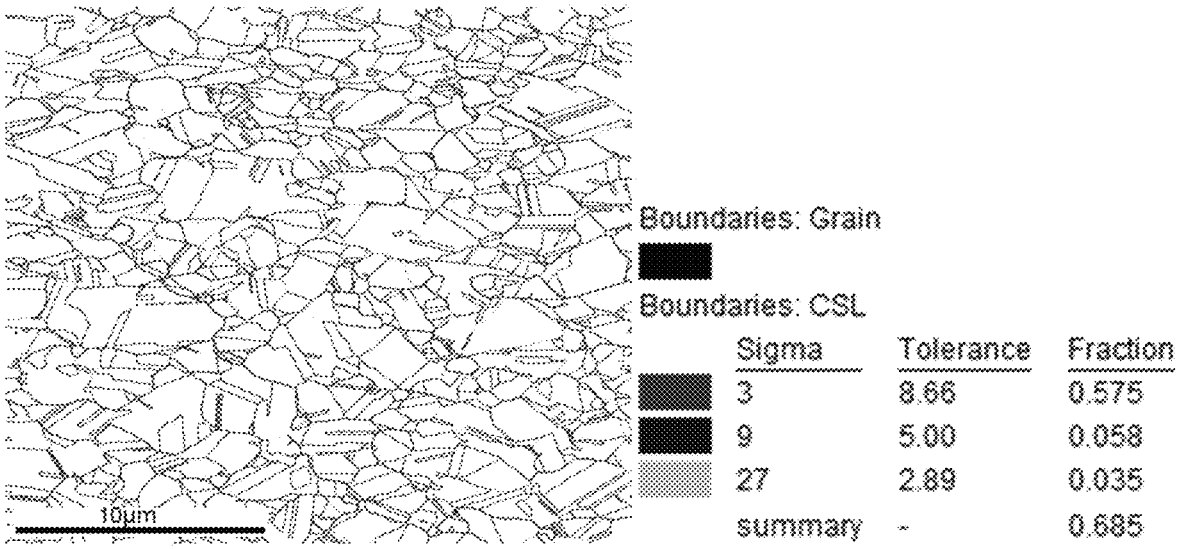
FIG. 3 shows the photograph of the microstructure and the special grain boundary proportion diagram of the modified tin-phosphor bronze alloy provided in Embodiment 12 of this disclosure.
Figure 4:
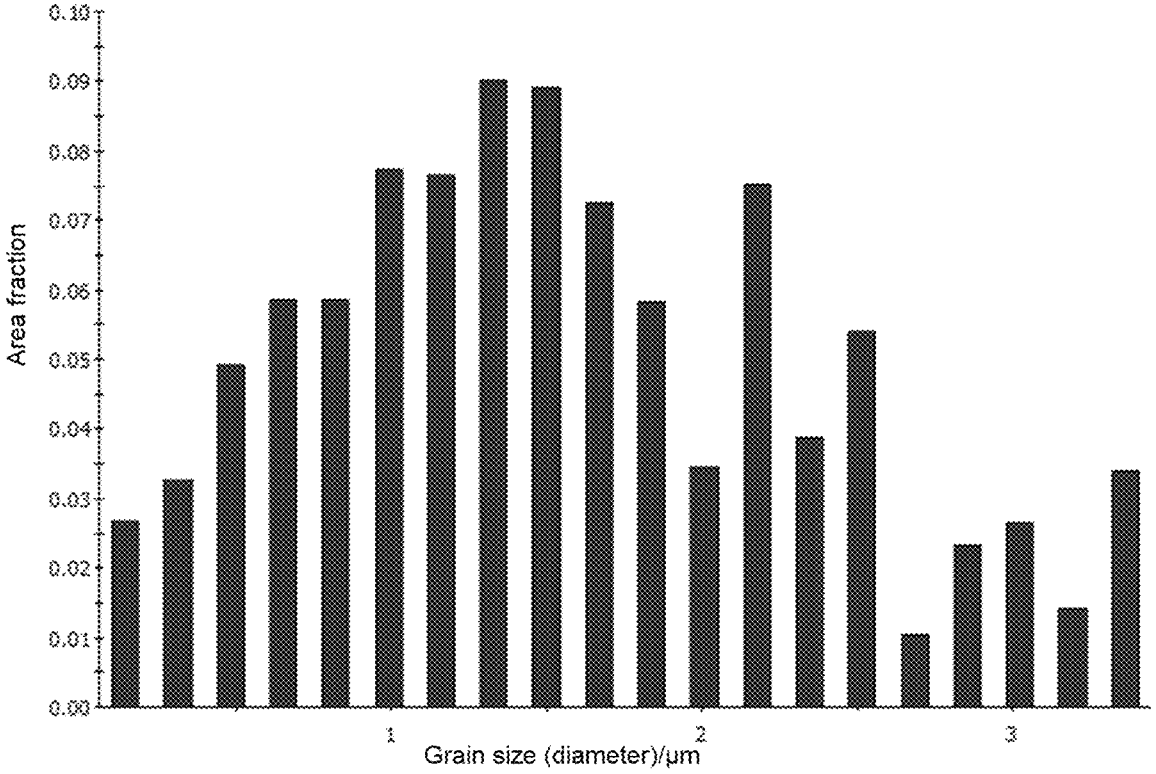
FIG. 4 shows the grain size distribution diagram of the modified tin-phosphor bronze alloy provided in Embodiment 12 of this disclosure.
Figure 5:
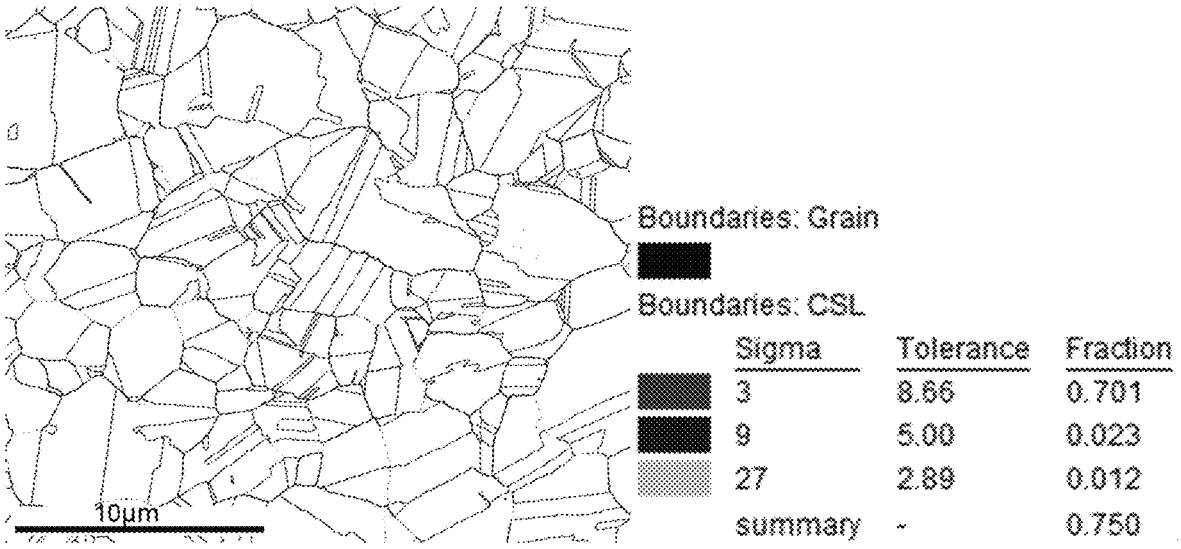
FIG. 5 shows the photograph of the microstructure and the special grain boundary proportion diagram of a finished tin-phosphor bronze alloy provided in Comparative embodiment 1 of this disclosure.
Figure 6:
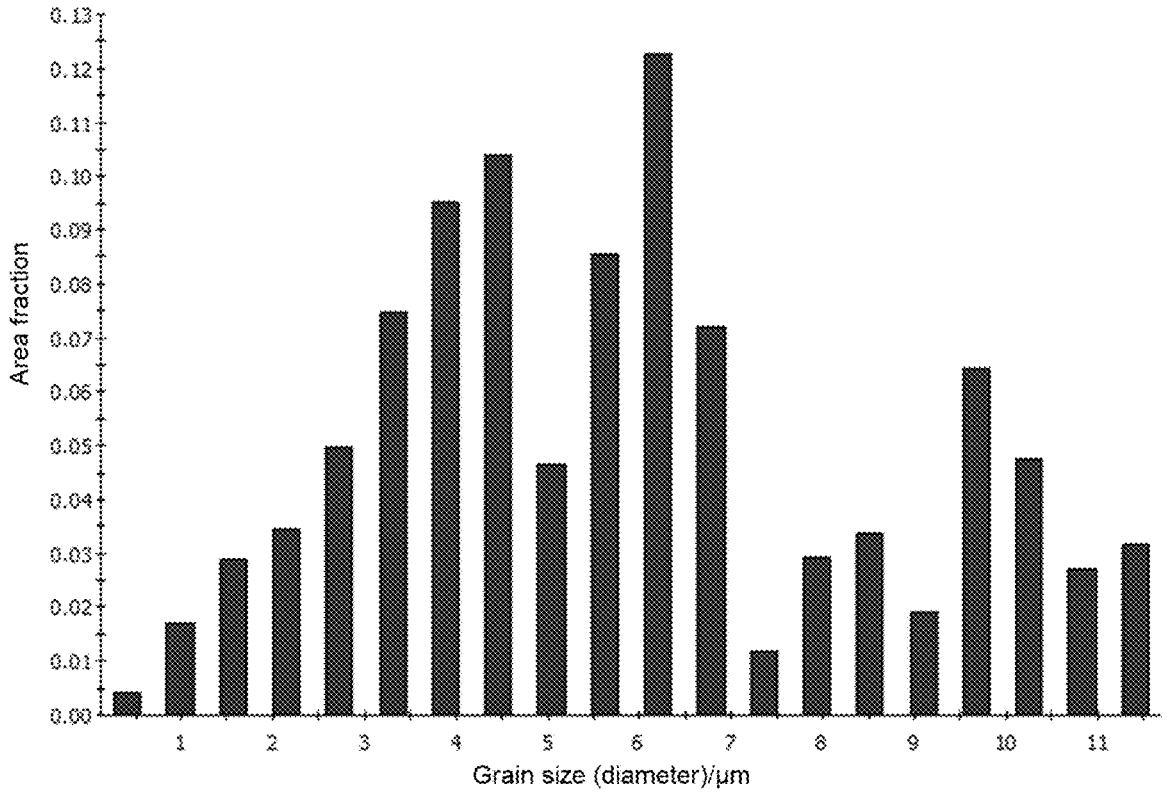
FIG. 6 shows the grain size distribution diagram of a tin-phosphor bronze alloy provided in Comparative embodiment 1 of this disclosure.

It should be noted that the embodiments and features in the embodiments in the present disclosure can be combined with each other without conflicting. The present disclosure will be described in detail below with reference to the drawings and in combination with embodiments.

As analyzed in the background art of this disclosure, there is a problem in the prior art that the tin-phosphor bronze cannot achieve high mechanical strength and excellent bending formability at the same time due to the low proportion of special boundaries. In order to solve this problem, this disclosure provides a modified tin-phosphor bronze alloy and a preparation method thereof.

In a typical embodiment of this disclosure, a modified tin-phosphor bronze alloy is provided, which includes the following elements in percentage by mass: 4.0-10 wt % of Sn, 0.01-0.3 wt % of P and the balance of Cu and inevitable impurity elements, wherein the average grain size of the modified tin-phosphor bronze alloy is 1-3 μm, the grain size is in normal distribution, and the standard deviation of the grain size is below 0.8 μm; the proportion of the total low-ΣCSL grain boundary in the modified tin-phosphor bronze alloy in the whole grain boundary is 66-74%, and in the total low-ΣCSL grain boundary, the ratio range of (Σ9+Σ27)/Σ3 is 0.12-0.23:1.

Compared with traditional tin-phosphor bronze, on the one hand, the average grain size of the modified tin-phosphor bronze alloy in this disclosure is 1-3 μm, the grain size is in uniform normal distribution with a standard deviation of below 0.8 μm, achieving the fine and uniform grain structure, and ensuring that the stress relaxation resistance of the tin-phosphor bronze alloy is not affected, which enables the modified tin-phosphor bronze alloy to fully play the role of fine-grain strengthening, thereby obtaining a modified tin-phosphor bronze alloy with higher strength. On the other hand, the modified tin-phosphor bronze alloy of this disclosure has a low-ΣCSL grain boundary with a high length fraction, a large amount of special boundaries can effectively hinder the dislocation movement, and have lower volume free energy, that is, on the premise of controlling the average grain size of the modified tin-phosphor bronze alloy at 1-3 μm, allowing the proportion of total low-ΣCSL grain boundaries to be higher, especially by controlling the content of sum of Σ9 and Σ27 grain boundaries and the proportion of Σ3 grain boundaries within the above range, allowing the deformation amount in the subsequent finished product processing to be relatively small, so that the required strength requirements can be achieved, while retaining more proportions of special boundaries, so that the finished alloy has more excellent bending processing resistance, and further, the finished alloy can give consideration to both tensile strength and excellent bending performance.

In one embodiment of this disclosure, in the above mentioned total low-ΣCSL grain boundary, the length fraction of the Σ3 grain boundary is 56-61%, the length fraction of the Σ9 grain boundary is 5-8%, and the length fraction of the Σ27 grain boundary is 2.5-4.5%.

In the CSL model, a new lattice is formed by atoms that overlap at certain positions in crystals with different orientations, known as the CSL lattice, and its numerical value is represented by the ratio Σ of CSL cell volume to crystal lattice cell volume. Σ is the density of overlapping positions, which represents the reciprocal of the ratio of the number of overlapping lattice positions to the total number of lattice positions in the CSL model, the smaller the Σ value, the more the overlapping lattice positions. Generally, the low Σ The grain boundary is called as a special grain boundary, which means the CSL grain boundary with interface $3 \leq \Sigma \leq 29$, the larger the Σ, the smaller the CSL density. However, when the grain boundary energy is high, the atoms on the overlapping position lattice grain boundaries may not strictly occupy the specified geometric positions, but have a tendency of spontaneous decrease in energy, causing rigid relaxation of the grain boundary atoms while meeting the Brandon standard. Therefore, it is necessary to introduce a large amount of low-ΣCSL grain boundaries through thermo-mechanical process, especially Σ3, Σ9 and Σ27 grain boundaries, in this disclosure the Σ3, Σ9 and Σ27 grain boundaries are preferably within the above range, and the ratio of (Σ9+Σ27)/Σ3 is in the range of 0.12-0.23:1. These high proportion of special boundaries can effectively hinder the dislocation movement and maintain a higher proportion of special boundaries during the subsequent finished product processing, reducing the proportion of ordinary high-angle grain boundaries, which further enhances the crack stopping and anti-cracking effect of the alloy during bending processing, thereby making the finished alloy have more excellent bending formability.

In one embodiment of this disclosure, the above mentioned standard deviation is 0.6-0.8 μm.

The standard deviation of the modified tin-phosphor bronze alloy is preferably within the above range, which is more conducive to improving the overall uniformity and stability of the modified tin-phosphor bronze alloy, so that the modified tin-phosphor bronze alloy can fully play the role of fine-grain strengthening, thereby obtaining a modified tin-phosphor bronze alloy with higher strength.

In another typical embodiment of this disclosure, a preparation method of the above mentioned modified tin-phosphor bronze alloy is provided, which includes subjecting the pretreated tin-phosphor bronze alloy workpiece to modification treatment so as to obtain the modified tin-phosphor bronze alloy; wherein the modification treatment includes a cold rolling deformation step and a heat treatment step carried out sequentially and wherein the average grain size of the pretreated tin-phosphor bronze alloy workpiece is 1-3 μm.

Due to the fact that tin-phosphor bronze is middle-low stacking fault energy face-centered cubic metal, a large amount of annealed twinning can be formed through cold rolling deformation and heat treatment steps carried out sequentially. The low-ΣCSL grain boundaries can be significantly improved in the random grain boundary network by controlling the deformation and heat treatment processes, especially the Σ3 grain boundaries and their geometrically related Σ9 and Σ27 grain boundaries, these grain boundaries have a significant effect on disrupting the connectivity of the random grain boundary network and improving the bending performance of the alloy, and the growth of grain structure will not occur, ultimately achieving the optimization of grain boundary character distribution (GBCD) of the tin-phosphor bronze materials. At the same time, smaller grain sizes help to make the fine-grain tin-phosphor bronze strip have higher strength and excellent bending formability, thereby maintaining excellent mechanical strength and bending formability after deformation of the subsequent finished strips.

In one embodiment of this disclosure, the deformation amount of the above mentioned cold rolling deformation step is 7-15%.

The strain energy of the GBE treated fine-grain tin-phosphor bronze strip within the above mentioned deformation range is stored throughout the entire grain, which means that the strip does not undergo conventional recrystallization nucleation, but undergoes a strain induced grain boundary migration. If the deformation amount is too large and the annealing time is too long, it will provide greater driving force for grain boundary migration and produce overall strain induced grain growth, rather than selective migration of noncoherent Σ3ic; and if the deformation amount is insufficient, insufficient strain will only result in recovery without any interface migration.

In one embodiment of this disclosure, the temperature of the above mentioned heat treatment step is 380-500° C., and the heat preservation time of the above mentioned heat treatment step is 1-4 hours.

On the basis of the above mentioned cold rolling deformation amount, if the heat treatment temperature is too high or the heat treatment time is too long, it is easy to cause grain growth to a certain extent. Moreover, the movable noncoherent $\Sigma 3_{ic}$ grain boundaries are reduced, which will inevitably inhibit the formation of the Σ9 and Σ27 grain boundaries, causing a decrease in Σ9 and Σ27 grain boundaries, even if the coherent $\Sigma 3_c$ is increased, resulting in an increase in overall low-ΣCSL grain boundaries, due to most of them are unmovable $\Sigma 3_c$ grain boundaries, it is of little benefit in disrupting the connectivity of high-angle grain boundary (HAGB) random network. Therefore, it is necessary to increase the amount of non-coherent $\Sigma 3_{ic}$ grain boundaries on the basis of increasing the overall low-ΣCSL grain boundaries, the corresponding Σ9 and Σ27 grain boundaries will also increase, and these grain boundaries are beneficial in disrupting the connectivity of the HAGB random network. If the heat treatment temperature is too low or the heat treatment time is too short, although the growth of grains will not occur, it also means that the maximum content fraction of Σ3 will not be significantly developed, which also leads to no developing in overall low-ΣCSL grain boundaries. Therefore, on the basis of the cold rolling deformation amount, it is helpful to balance the small grain size and high proportion of special boundaries of fine-grain tin-phosphor bronze strip by controlling the temperature and holding time of the heat treatment step within the above range.

In one embodiment of this disclosure, the above mentioned preparation method further comprises: repeating the modification treatment multiple times, preferably performing 2-5 times of the modification treatment.

The degree of the cold rolling deformation and heat treatment steps mentioned above is relatively mild. The above modification treatment is preferably repeated for 2-5 times, which helps to obtain the modified tin-phosphor bronze alloy that conforms to requirement of high proportion of special boundaries.

In one embodiment of this disclosure, the above mentioned preparation method further includes a preparation process flow of the pretreated tin-phosphor bronze alloy workpiece, which includes a batching step, a horizontal continuous casting step, a homogenization annealing step, a face milling step, a cold rolling cogging step, a first recrystallization annealing step, an intermediate rolling deformation step, a second recrystallization annealing step, a finish rolling deformation step, a third recrystallization annealing step, a bottom reservation rolling step, and a fourth recrystallization annealing step carried out sequentially, wherein the temperature of the homogenization annealing step is 650-690° C., and the heat preservation time of the homogenization annealing step is 6-8 hours; and the deformation amount of the cold rolling cogging step is 80-90%; the deformation amount of the bottom reservation rolling step is 40-55%; the deformation amount of the intermediate rolling deformation step is 50-70%; and the deformation amount of the finish rolling deformation step is 40-60%.

The synergistic control and treatment of the cold deformation and heat treatment processes in each step of the above mentioned preparation methods helps to obtain the pretreated tin-phosphor bronze alloy workpiece with uniform grain structure and fine grain size.

Firstly, through a homogenization annealing step at a heating temperature of 650-690° C. for a heat preservation time of 6-8 hours, the micro segregation in tin-phosphor bronze is basically eliminated, and the tin element in the alloy has completely solubilized into the matrix, and through this process, the grain size of the matrix structure can be controlled within a reasonable range. Due to the homogenization time shortens with the increasing of temperature, the higher the temperature, the faster the atomic diffusion rate. However, as the heat preservation time prolongs, the diffusion flow rate decreases with the decrease of concentration gradient, weakening the homogenization effect. Excessive heat preservation time is of less significance, as it not only increases the energy consumption, but also easily leads to the growth of grain structure subsequently. If the temperature is too low, the expected homogenization annealing effect cannot be achieved. At the same time, excessively high temperatures can also easily cause the growth of grain structure, making it difficult to provide a relatively small original grain structure for subsequent processes.

Secondly, the deformation amount of the cold rolling cogging step is controlled at 80-90%, this deformation amount can not only fully break up some of the discrete and uneven structures that exist in the homogenization annealing stage, forming more recrystallization nucleation cores, providing assurance for the subsequent recrystallization annealing to obtain fine and uniform grain structures, but also within this deformation range, more Σ3 grain boundaries can be formed in the subsequent annealing process, these Σ3 grain boundaries can more effectively hinder the dislocation movement during the plastic deformation, providing more deformation energy storage for the subsequent cold deformation, compared to ordinary high-angle grain boundaries.

In one embodiment of this disclosure, the temperature of the above mentioned first recrystallization annealing step is 540-580° C., and the heat preservation time of the first recrystallization annealing step is 4-6 hours; the temperature of the second recrystallization annealing step is 450-500° C., and the heat preservation time of the second recrystallization annealing step is 4-6 hours.

The control of the temperature and time for the first recrystallization annealing not only ensures that the grain structure of the alloy has undergone complete recrystallization, so that the grain structure is finer than that of the homogenization stage, but also ensures that no growth of grains will occur. By combining 50-70% of the intermediate rolling deformation amount and the second recrystallization annealing step, the grain size of the alloy is further controlled to be further refined and uniformly distributed.

In one embodiment of this disclosure, the temperature of the above mentioned third recrystallization annealing step is 650-750° C., and the heat preservation time of the third recrystallization annealing step is 20-60 seconds; the temperature of the fourth recrystallization annealing step is 600-650° C., and the heat preservation time of the fourth recrystallization annealing step is 20-60 seconds.

Similarly, through finish rolling deformation step, the third recrystallization annealing step, bottom reservation rolling step, and the fourth recrystallization annealing step, the average grain size of the pretreated tin-phosphor bronze alloy workpiece is ultimately controlled at 1-3 μm after the fourth recrystallization annealing step, and it is uniformly distributed.

In some embodiments of this disclosure, the atmospheres for the above mentioned first recrystallization annealing step and the second recrystallization annealing step are each independently a first mixed gas of nitrogen and hydrogen, and the first mixed gas comprises 15-30% of $H_2$ and 70-85% of $N_2$ in percentage by volume; the atmospheres for the third recrystallization annealing step and the fourth recrystallization annealing step are each independently a second mixed gas of nitrogen and hydrogen, and the second mixed gas comprises 3-5% of $H_2$ and 95-97% of $N_2$ in percentage by volume, which helps to improve the surface quality of the recrystallized annealing strips and is beneficial to maintain the stability of the alloy in each recrystallization annealing step.

The beneficial effect of this disclosure will be further explained below in combination with the embodiments.

The modified tin-phosphor bronze alloys were prepared according to the preparation method of the present disclosure for 23 Embodiments and 3 Comparative embodiments.

The specific compositions are shown in Table 1. The preparation process flow included: a batching step, a horizontal continuous casting step, a homogenization annealing step, a face milling step, a cold rolling cogging step, a first recrystallization annealing step, an intermediate rolling deformation step, a second recrystallization annealing step, a finish rolling deformation step, a third recrystallization annealing step, a bottom reservation rolling step, a fourth recrystallization annealing step, a cold rolling deformation step, a heat treatment step, an H-state rolling and stress relief annealing step of the finished product, a cleaning, and a straightening and shearing of the finished product. The controls of specific process parameters are shown in Tables 2 and 3.

The comparative embodiments 1 and 2 were tested based on Embodiment 12, respectively.

Comparative Embodiment 3

The difference from Embodiment 1 lied in that, the tin bronze material was cut with a wire cutting tool, specifically included cutting the tin bronze material according to the length requirements for the process along the rolling direction, transverse direction, and normal direction of the tin bronze material to obtain several three-dimensional workpieces, respectively, for example, cutting 20 mm, 9 mm, and 3 mm of the tin bronze material along the rolling direction, transverse direction, and normal direction, respectively to obtain rectangular block workpieces, then performing a 20% of cold deformation amount on the tin bronze sheet, subjecting the rectangular block workpieces to heat treatment at 680° C. for 1800 seconds to obtain the finished product of the tin bronze material.

TABLE 1

| Embodiments/Comparative embodiments | Contents of Sn and P in tin-phosphor bronze alloys |
|---|---|
| Embodiments 1-4 | 4.0 wt % of Sn, 0.1 wt % of P (Strip Model C51100) |
| Embodiments 5-8 | 6.5 wt % of Sn, 0.3 wt % of P (Strip Model C51910) |
| Embodiments 9-12, Comparative embodiments 1-3 | 8.0 wt % of Sn, 0.1 wt % of P (Strip Model C52100) |
| Embodiments 13-23 | 10.0 wt % of Sn, 0.1 wt % of P (Strip Model C52400) |

TABLE 2

| Embodiments/Comparative embodiments | Temperature and time of homogenization annealing | Cold rolling cogging deformation amount (%) | Temperature and time of first recrystallization annealing | Intermediate rolling deformation amount (%) | Temperature and time of second recrystallization annealing | Finish rolling deformation amount (%) | Temperature and time of third recrystallization annealing |
|---|---|---|---|---|---|---|---|
| Embodiment 1 | 650° C., 8 h | 80 | 540° C., 6 h | 70 | 460° C., 6 h | 50 | 430° C., 4 h |
| Embodiment 2 | 660° C., 8 h | 83 | 550° C., 6 h | 65 | 470° C., 6 h | 55 | 440° C., 3 h |
| Embodiment 3 | 670° C., 7 h | 85 | 560° C., 5 h | 60 | 500° C., 4 h | 60 | 450° C., 2 h |
| Embodiment 4 | 680° C., 7 h | 87 | 570° C., 4 h | 55 | 490° C., 4 h | 40 | 460° C., 1 h |
| Embodiment 5 | 690° C., 6 h | 90 | 580° C., 4 h | 50 | 480° C., 5 h | 45 | 430° C., 3 h |
| Embodiment 6 | 650° C., 8 h | 83 | 560° C., 5 h | 55 | 470° C., 5 h | 55 | 430° C., 4 h |
| Embodiment 7 | 660° C., 8 h | 85 | 570° C., 4 h | 50 | 460° C., 6 h | 60 | 440° C., 4 h |
| Embodiment 8 | 670° C., 7 h | 87 | 580° C. 4 h | 70 | 490° C., 4 h | 40 | 450° C., 2 h |
| Embodiment 9 | 680° C., 7 h | 90 | 540° C., 6 h | 65 | 480° C., 4 h | 45 | 440° C., 3 h |
| Embodiment 10 | 690° C., 6 h | 80 | 550° C., 6 h | 60 | 500° C., 4 h | 50 | 460° C., 1 h |
| Embodiment 11 | 650° C., 8 h | 85 | 570° C., 4 h | 50 | 480° C., 4 h | 60 | 460° C., 2 h |
| Embodiment 12 | 660° C., 8 h | 87 | 580° C., 4 h | 70 | 500° C., 4 h | 40 | 460° C., 1 h |
| Embodiment 13 | 670° C., 7 h | 90 | 540° C., 6 h | 65 | 460° C., 6 h | 45 | 430° C., 4 h |
| Embodiment 14 | 680° C., 7 h | 80 | 550° C., 6 h | 60 | 490° C., 4 h | 50 | 440° C., 3 h |
| Embodiment 15 | 690° C., 6 h | 83 | 560° C., 5 h | 55 | 470° C., 5 h | 55 | 430° C., 4 h |
| Embodiment 16 | 680° C., 7 h | 80 | 550° C., 6 h | 60 | 490° C., 4 h | 50 | 440° C., 3 h |
| Embodiment 17 | 680° C., 7 h | 80 | 550° C., 6 h | 60 | 490° C., 4 h | 50 | 440° C., 3 h |
| Embodiment 18 | 680° C., 7 h | 80 | 550° C., 6 h | 60 | 490° C., 4 h | 50 | 440° C., 3 h |
| Embodiment 19 | 680° C., 7 h | 80 | 550° C., 6 h | 60 | 490° C., 4 h | 50 | 440° C., 3 h |
| Embodiment 20 | 680° C., 7 h | 80 | 550° C., 6 h | 60 | 490° C., 4 h | 50 | 440° C., 3 h |

TABLE 2-continued

| Embodiments/ Comparative embodiments | Temperature and time of homogenization annealing | Cold rolling cogging deformation amount (%) | Temperature and time of first recrystallization annealing | Intermediate rolling deformation amount (%) | Temperature and time of second recrystallization annealing | Finish rolling deformation amount (%) | Temperature and time of third recrystallization annealing |
|---|---|---|---|---|---|---|---|
| Embodiment 21 | 680° C., 7 h | 80 | 550° C., 6 h | 60 | 490° C., 4 h | 50 | 440° C., 3 h |
| Embodiment 22 | 680° C., 7 h | 80 | 550° C., 6 h | 60 | 490° C., 4 h | 50 | 440° C., 3 h |
| Embodiment 23 | 680° C., 7 h | 80 | 550° C., 6 h | 60 | 490° C., 4 h | 50 | 440° C., 3 h |
| Comparative embodiment 1 | 680° C., 7 h | 90 | 540° C., 6 h | 65 | 480° C., 4 h | 45 | 440° C., 3 h |
| Comparative embodiment 2 | 680° C., 7 h | 90 | 540° C., 6 h | 65 | 480° C., 4 h | 45 | 440° C., 3 h |

TABLE 3

| Embodiments/ Comparative embodiments | Bottom reservation rolling/ % | Temperature and time of fourth recrystallization annealing | Average grain size/ μm | Total low-Σ CSL grain boundary before GBE/ % | Small deformation/ % | Temperature and time of GBE annealing | Average grain size/ μm | Standard deviation/ μm |
|---|---|---|---|---|---|---|---|---|
| Embodiment 1 | 45 | 400° C., 2 h | 1.2 | 62 | 18 | 750° C., 40 s | 1.2 | 0.64 |
| Embodiment 2 | 42 | 410° C., 2 h | 1.6 | 61 | 22 | 650° C., 60 s | 1.5 | 0.66 |
| Embodiment 3 | 40 | 390° C., 3 h | 2.4 | 60 | 25 | 700° C., 80 s | 2.5 | 0.82 |
| Embodiment 4 | 55 | 430° C., 1 h | 2.8 | 58 | 15 | 600° C., 120 s | 2.8 | 0.90 |
| Embodiment 5 | 55 | 380° C., 4 h | 1.0 | 55.5 | 20 | 680° C., 80 s | 1.1 | 0.62 |
| Embodiment 6 | 42 | 390° C., 3 h | 1.0 | 58 | 15 | 650° C., 60 s | 1.0 | 0.60 |
| Embodiment 7 | 43 | 400° C., 2 h | 1.8 | 62 | 17 | 700° C., 70 s | 1.8 | 0.76 |
| Embodiment 8 | 50 | 420° C., 1 h | 2.8 | 60 | 25 | 600° C., 120 s | 2.7 | 0.86 |
| Embodiment 9 | 40 | 380° C., 3 h | 1.6 | 59.5 | 23 | 750° C., 40 s | 1.5 | 0.70 |
| Embodiment 10 | 55 | 410° C., 2 h | 2.5 | 55 | 20 | 720° C., 50 s | 2.6 | 0.84 |
| Embodiment 11 | 50 | 430° C. 1 h | 2.0 | 54.5 | 23 | 700° C., 80 s | 2.1 | 0.78 |
| Embodiment 12 | 55 | 380° C., 3 h | 1.3 | 56 | 25 | 750° C., 40 s | 1.3 | 0.66 |
| Embodiment 13 | 40 | 390° C., 4 h | 1.1 | 60 | 20 | 600° C., 120 s | 1.0 | 0.60 |
| Embodiment 14 | 55 | 400° C., 3 h | 2.6 | 62 | 17 | 650° C., 60 s | 2.7 | 0.86 |
| Embodiment 15 | 45 | 410° C., 2 h | 1.6 | 61 | 15 | 670° C., 60 s | 1.6 | 0.72 |
| Embodiment 16 | 55 | 400° C., 3 h | 2.6 | 62 | 25 | 650° C., 60 s | 2.8 | 0.88 |
| Embodiment 17 | 55 | 400° C., 3 h | 2.6 | 62 | 10 | 650° C., 60 s | 2.7 | 0.90 |
| Embodiment 18 | 55 | 400° C., 3 h | 2.6 | 62 | 30 | 650° C., 60 s | 3.0 | 0.90 |
| Embodiment 19 | 55 | 400° C., 3 h | 2.6 | 62 | 17 | 600° C., 60 s | 2.6 | 0.86 |
| Embodiment 20 | 55 | 400° C., 3 h | 2.6 | 62 | 17 | 750° C., 60 s | 2.9 | 0.89 |
| Embodiment 21 | 55 | 400° C., 3 h | 2.6 | 62 | 17 | 550° C., 60 s | 2.6 | 0.88 |
| Embodiment 22 | 55 | 400° C., 3 h | 2.6 | 62 | 17 | 650° C., 120 s | 2.9 | 0.88 |
| Embodiment 23 | 55 | 400° C., 3 h | 2.6 | 62 | 17 | 650° C., 150 s | 3.0 | 0.90 |

TABLE 3-continued

| Embodiments/ Comparative embodiments | Bottom reservation rolling/ % | Temperature and time of fourth recrystallization annealing | Average grain size/ μm | Total low-Σ CSL grain boundary before GBE/ % | Small deformation/ % | Temperature and time of GBE annealing | Average grain size/ μm | Standard deviation/ μm |
|---|---|---|---|---|---|---|---|---|
| Comparative embodiment 1 | 40 | 380° C., 3 h | 1.6 | 59.5 | 23 | 800° C., 120 s | 5.0 | 2.8 |
| Comparative embodiment 2 | 40 | 380° C., 3 h | 1.6 | 59.5 | 23 | 550° C., 20 s | 1.6 | 0.95 |

Performance Testing Methods:

Tensile strength: tensile test at room temperature was conducted in accordance with GB/T 228.1-2021 Metallic Materials Tensile Testing Part 1: Test method at room temperature, the test was conducted on an electronic universal mechanical performance testing machine, and standard dumbbell shaped specimens were used for tensile testing.

Organizational analysis: Grain structure testing was conducted using scanning electron microscopy (EBSD) for analysis, the cross-sectional structure (longitudinal section) of the finished product sample along the rolling direction was magnified 1000 times and 5000 times for observation. The average grain size and standard deviation of the sample were tested using OIM8.0 analysis software to evaluate the grain size of the sample and uniform distribution of grains. At the same time, the CSL grain boundaries of the tin-phosphor bronze alloys (Σ3, Σ9 and Σ27) can also be analyzed.

Bending performance: the bending performance testing was conducted in accordance with GB/T 232-010 Metal materials bending test methods. The 90° bending test was conducted on the HSL-BT-90 bending test machine, with a sample width of 10 mm and a length of 50 mm.

The specific performance parameters of the modified tin-phosphor bronze alloys in Embodiments 1-23, and Comparative embodiments 1-3 are listed in Table 4.

TABLE 4

| Embodiments/ Comparative embodiments | H-state tensile strength of the finished product/ MPa | H-state elongation of the finished product/ % | Bending formability R/t | Total low-Σ CSL grain boundary after GBE/ % | Proportion of Σ3 grain boundary/ % | Proportion of Σ9 grain boundary/ % | Proportion of Σ27 grain boundary/ % | (Σ9 + Σ27/ Σ3 |
|---|---|---|---|---|---|---|---|---|
| Embodiment 1 | 585 | 21 | 0 | 73 | 59.5 | 7.4 | 4.3 | 0.20 |
| Embodiment 2 | 590 | 20 | 0 | 72 | 59 | 7.2 | 4.4 | 0.20 |
| Embodiment 3 | 580 | 19 | 0 | 69 | 57.9 | 5.8 | 3.5 | 0.16 |
| Embodiment 4 | 575 | 20 | 0 | 68 | 57.1 | 5.6 | 2.8 | 0.15 |
| Embodiment 5 | 630 | 22 | 0 | 66 | 56 | 5 | 2.5 | 0.13 |
| Embodiment 6 | 631 | 22 | 0 | 68 | 57 | 5.7 | 2.8 | 0.15 |
| Embodiment 7 | 626 | 23 | 0 | 74 | 60 | 7.5 | 4.5 | 0.20 |
| Embodiment 8 | 622 | 22.5 | 0 | 69 | 57.8 | 5.9 | 3.5 | 0.16 |
| Embodiment 9 | 634 | 35 | 0 | 68.5 | 57.5 | 5.8 | 3.5 | 0.16 |
| Embodiment 10 | 626 | 32 | 0 | 66.5 | 56.2 | 5.4 | 2.7 | 0.14 |
| Embodiment 11 | 628 | 32 | 0 | 66 | 56 | 5.3 | 2.6 | 0.14 |
| Embodiment 12 | 638 | 34 | 0 | 67 | 56.8 | 5.6 | 2.7 | 0.15 |
| Embodiment 13 | 690 | 23 | 0 | 70 | 58 | 6.5 | 3.2 | 0.17 |
| Embodiment 14 | 680 | 25 | 0 | 74 | 60 | 8 | 4.1 | 0.20 |
| Embodiment 15 | 685 | 24 | 0 | 72 | 58.8 | 7.1 | 4.3 | 0.19 |
| Embodiment 16 | 680 | 24.5 | 0 | 74 | 60.5 | 7.8 | 3.9 | 0.19 |
| Embodiment 17 | 680 | 19.5 | 1.06 | 66 | 55 | 4.5 | 2.1 | 0.12 |
| Embodiment 18 | 670 | 20.0 | 1.06 | 74 | 63 | 4.9 | 2.6 | 0.12 |
| Embodiment 19 | 685 | 24.5 | 0 | 73 | 59 | 7.9 | 4.0 | 0.20 |
| Embodiment 20 | 685 | 24.5 | 0 | 74 | 62 | 7.5 | 3.6 | 0.18 |
| Embodiment 21 | 670 | 20.5 | 1.06 | 66.5 | 56 | 4.5 | 2.2 | 0.12 |
| Embodiment 22 | 675 | 25 | 0 | 74 | 63 | 7.4 | 3.7 | 0.18 |
| Embodiment 23 | 660 | 19.5 | 1.06 | 74 | 64 | 5.1 | 2.6 | 0.12 |
| Comparative embodiment 1 | 610 | 20.5 | 2.12 | 75 | 70.1 | 2.3 | 1.2 | 0.05 |
| Comparative embodiment 2 | 620 | 18.5 | 2.54 | 41 | 36 | 2.1 | 1.1 | 0.09 |
| Comparative embodiment 3 | 610 | 16.5 | 2.97 | 73 | 68 | 2.0 | 0.9 | 0.04 |

It could be seen from the above descriptions that the above embodiments of the present disclosure had achieved the following technical effects:

Compared with traditional tin-phosphor bronze, on the one hand, the average grain size of the modified tin-phosphor bronze alloy in this disclosure was 1-3 μm, the grain size was in uniform normal distribution with a standard deviation of below 0.9 μm, achieving the fine and uniform grain structure, so that the modified tin-phosphor bronze alloy could fully play the role of fine-grain strengthening, thereby obtaining a modified tin-phosphor bronze alloy with higher strength. On the other hand, the modified tin-phosphor bronze alloy of this disclosure had a low-ΣCSL grain boundary with a high length fraction, a large amount of special boundaries could effectively hinder the dislocation movement, and had lower volume free energy, that was, on the premise of controlling the average grain size of the modified tin-phosphor bronze alloy at 1-3 μm, allowing the proportion of total low-ΣCSL grain boundaries to be higher, especially by controlling the content of sum of Σ9 and Σ27 grain boundaries and the proportion of Σ3 grain boundaries within the above range, allowing the deformation amount in the subsequent finished product processing to be relatively small, so that the required strength requirements could be achieved, while retaining more proportions of special boundaries, so that the finished alloy had more excellent bending processing resistance, and further, the finished alloy could give consideration to both tensile strength and excellent bending performance.

The above contents only describe the preferred embodiments of the present disclosure, and are not intended to limit the present disclosure. For those skilled in the art, various modifications and changes can be made to the present disclosure. Any modifications, equivalent substitutions, improvements, and the like made within the spirit and principle of the disclosure shall be included within the scope of protection of the disclosure.

What is claimed is:

1. A preparation method of a modified tin-phosphor bronze alloy, wherein, the preparation method comprises:

subjecting a pretreated tin-phosphor bronze alloy workpiece to modification treatment so as to obtain the modified tin-phosphor bronze alloy;

wherein, the modification treatment comprises a cold rolling deformation step and a heat treatment step carried out sequentially;

wherein, the average grain size of the pretreated tin-phosphor bronze alloy workpiece is 1-3 μm;

the deformation amount of the cold rolling deformation step is 7-15%;

the temperature of the heat treatment step is 380-500° C.;

the heat preservation time of the heat treatment step is 1-4 hours;

the preparation method further comprises a preparation process flow of the pretreated tin-phosphor bronze alloy workpiece, which comprises a batching step, a horizontal continuous casting step, a homogenization annealing step, a face milling step, a cold rolling cogging step, a first recrystallization annealing step, an intermediate rolling deformation step, a second recrystallization annealing step, a finish rolling deformation step, a third recrystallization annealing step, a bottom reservation rolling step, and a fourth recrystallization annealing step carried out sequentially, wherein the temperature of the homogenization annealing step is 650-690° C.;

the temperature of the third recrystallization annealing step is 650-750° C., and the heat preservation time of the third recrystallization annealing step is preferably 20-60 seconds;

the temperature of the fourth recrystallization annealing step is 600-650° C., and the heat preservation time of the fourth recrystallization annealing step is preferably 20-60 seconds;

the atmospheres for the third recrystallization annealing step and the fourth recrystallization annealing step are each independently a second mixed gas of nitrogen and hydrogen, and the second mixed gas comprises 3-5% of $H_2$ and 95-97% of $N_2$ in percentage by volume;

the modified tin-phosphor bronze alloy comprising the following elements in percentage by mass: 4.0-10 wt % of Sn, 0.01-0.3 wt % of P and the balance of Cu and inevitable impurity elements, wherein, the average grain size of the modified tin-phosphor bronze alloy is 1-3 μm, the grain size is in normal distribution, and the standard deviation of the grain size is below 0.8 μm; the proportion of the total low-ΣCSL grain boundary in the modified tin-phosphor bronze alloy in the whole grain boundary is 66-74%, and in the total low-ΣCSL grain boundary, the ratio range of (Σ9+Σ27)/Σ3 is 0.12-0.23:1.

2. The preparation method according to claim 1, wherein, the preparation method further comprises: repeating the modification treatment multiple times.

3. The preparation method according to claim 1, wherein, the temperature of the first recrystallization annealing step is 540-580° C., and the heat preservation time of the first recrystallization annealing step is preferably 4-6 hours.

4. The preparation method according to claim 3, wherein, the atmospheres for the first recrystallization annealing step and the second recrystallization annealing step are each independently a first mixed gas of nitrogen and hydrogen, and the first mixed gas comprises 15-30% of $H_2$ and 70-85% of $N_2$ in percentage by volume.

5. The preparation method according to claim 2, wherein, performing 2-5 times of the modification treatment.

6. The preparation method according to claim 1, wherein, the heat preservation time of the homogenization annealing step is 6-8 hours.

7. The preparation method according to claim 1, wherein, the deformation amount of the cold rolling cogging step is 80-90%.

8. The preparation method according to claim 1, wherein, the deformation amount of the bottom reservation rolling step is 40-55%.

9. The preparation method according to claim 1, wherein, the deformation amount of the intermediate rolling deformation step is preferably 50-70%.

10. The preparation method according to claim 1, wherein, the deformation amount of the finish rolling deformation step is preferably 40-60%.

11. The preparation method according to claim 1, wherein, the temperature of the second recrystallization annealing step is 450-500° C., and the heat preservation time of the second recrystallization annealing step is preferably 4-6 hours.

12. The preparation method according to claim 1, wherein, in the total low-ΣCSL grain boundary, the length fraction of the Σ3 grain boundary is 56-61%, the length fraction of the Σ9 grain boundary is 5-8%, and the length fraction of the Σ27 grain boundary is 2.5-4.5%.

13. The preparation method according to claim 1, wherein, the standard deviation is 0.6-0.8 μm.

* * * * *